United States Patent [19]

Hemfort

[11] 4,015,772

[45] Apr. 5, 1977

[54] CONTINUOUSLY OPERATING CENTRIFUGE DRUM FOR THE STERILIZATION OF LIQUIDS

[75] Inventor: Heinrich Hemfort, Oelde, Germany

[73] Assignee: Westfalia Separator AG, Oelde, Germany

[22] Filed: Jan. 14, 1976

[21] Appl. No.: 649,165

[30] Foreign Application Priority Data

Jan. 18, 1975 Germany ..... 2501924

[52] U.S. Cl. ..... 233/20 A

[51] Int. Cl.[2] ..... B04B 1/14

[58] Field of Search ..... 233/20 R, 20 A, 46, 233/47 R, 19 R, 19 A, 27, 31, 37

[56] References Cited

UNITED STATES PATENTS

| | | | |
|---|---|---|---|
| 3,125,516 | 3/1964 | Kaldewey | 233/47 R |
| 3,403,849 | 10/1968 | Thylefors | 233/20 R |
| 3,460,750 | 8/1969 | Silla | 233/20 R |
| 3,462,076 | 8/1969 | Steinacker | 233/20 R |
| 3,847,327 | 11/1974 | Erikson | 233/47 R |

FOREIGN PATENTS OR APPLICATIONS

| | | | |
|---|---|---|---|
| 822,975 | 11/1951 | Germany | 233/20 A |
| 641,382 | 8/1950 | United Kingdom | 233/20 R |

*Primary Examiner*—George H. Krizmanich
*Attorney, Agent, or Firm*—Burgess, Dinklage & Sprung

[57] ABSTRACT

Centrifuge for use in sterilization of liquids, e.g., milk, by removal of bacteria as a sludge or concentrate. A chamber (e.g., 13) for the concentrate is disposed outwardly of the drum separating chamber (e.g., 9) and communicates with the separating chamber via a narrow gap (e.g., 12). Passageways (e.g., 14) are provided for discharge of the sludge from the concentrate chamber. Thereby accumulation of sludge in the separating chamber is limited so that the possibility of infecting the purified liquid with sludge is reduced.

9 Claims, 3 Drawing Figures

CONTINUOUSLY OPERATING CENTRIFUGE DRUM FOR THE STERILIZATION OF LIQUIDS

BACKGROUND

The invention relates to a continuously operating centrifuge drum for the sterilization of liquids, such as milk, fruit juices or the like, from which the extracted bacterial sludge is removed continuously or discontinuously. Such a centrifuge drum is known, for example, from German Pat. No. 1,062,185 (U.S. Pat. No. 3,217,982).

Centrifuges have been used for years for the sterilization of liquids, the sterilization of drinking milk and cheese making milk being of especial importance. According to known procedures, the milk that is to be sterilized is heated to the pasteurization temperature of about 72° C, and is then centrifuged in high-speed centrifuges at high centrifugal force, for the purpose of completely removing the bacteria not killed by the pasteurization, especially the spore-forming bacteria.

German Pat. No. 1,062,185 cited above describes, for example, a method of sterilizing liquids in a disk centrifuge, in which the fluid in which the bacteria have been concentrated is removed from the area outside of the disk stack through a free liquid outlet. Since, however, the bacterial sludge is produced not only in liquid form but also in solid form, a portion of the bacterial sludge remains in the solids chamber of the drum and, as it accumulates in the drum the centrifuged milk becomes reinfected with the bacteria, and it is essential to prevent this from happening.

The build-up of bacterial sludge in the solids chamber of centrifuges occurs not only in the centrifuge drums having imperforated side walls as shown in the above-cited patent, but also in the generally known nozzle centrifuges which have since come into use. The same also applies to "nozzle desludgers," as they are called, i.e., combinations of nozzle centrifuges and self-cleaning centrifuges or of self-cleaning centrifuges only.

It is disadvantageous in these nozzle centrifuges that, depending on the number and spacing of the nozzles, cones of sludge are formed in the solids chamber which protrude into the separating chamber and continuously reinfect the outflowing, centrifuged liquid.

THE INVENTION

The invention is addressed to the problem of developing a centrifuge drum for the sterilization of liquids which will prevent the reinfection of the centrifuged liquid by sludge, and thus will achieve a very thorough separation of bacteria, especially of spore-forming bacteria.

It has been found that the sterilizing effect can be significantly improved if the separating chamber is kept free of bacterial sludge, and if the sludge is collected in a smaller concentrate chamber concentrically surrounding the separating chamber and is carried out of the drum.

An important feature of the invention is that the concentrate chamber is connected with the separating chamber only through a narrow gap, in order thus to create a flowless area in the concentrate chamber. The bacterial sludge produced by the centrifugation and collecting in this concentrate chamber will then no longer come in contact with the centrifuged liquid flowing out of the drum. In addition to a very high angular velocity of the centrifuge drum, the conical surfaces in the separating chamber are best made very smooth and with rounded edges so as to prevent any entrapment of sludge and assure that the sludge will slip off of them smoothly into the concentrate chamber.

The centrifuge drum of the invention is characterized in that a concentrate chamber which is smaller than the separating chamber and is connected to the separating chamber by a narrow gap is disposed in the plane of the greatest diameter of the drum, and passages and nozzles are provided for removing the concentrate from the outer part of the concentrate chamber.

Another feature of this invention is that the width and shape of the concentrate chamber is so constructed that any cones of solids that might form between the discharge nozzles will not extend into the conical separating chamber and the concentrate chamber is of segment-shaped construction or is in the form of an annular channel. It has proven to be desirable that the discharge nozzles be disposed inwardly of the periphery of the drum, since a reduction of the amount of concentrate can thus be achieved together with a larger cross section in the nozzle.

Instead of nozzle centrifuges, self-cleaning centrifuges or combinations of both systems can be used, depending on the amount and the nature of the solids.

The concentrate discharged from the nozzles is either discarded, used as animal feed, or, after heating at temperatures around 140° C, it is returned to the centrifuged product, thus minimizing losses and waste. The construction of the centrifuge drum additionally permits a good chemical cleaning of the drum.

Three embodiments of the invention are represented in the drawings, wherein

Figure 1:
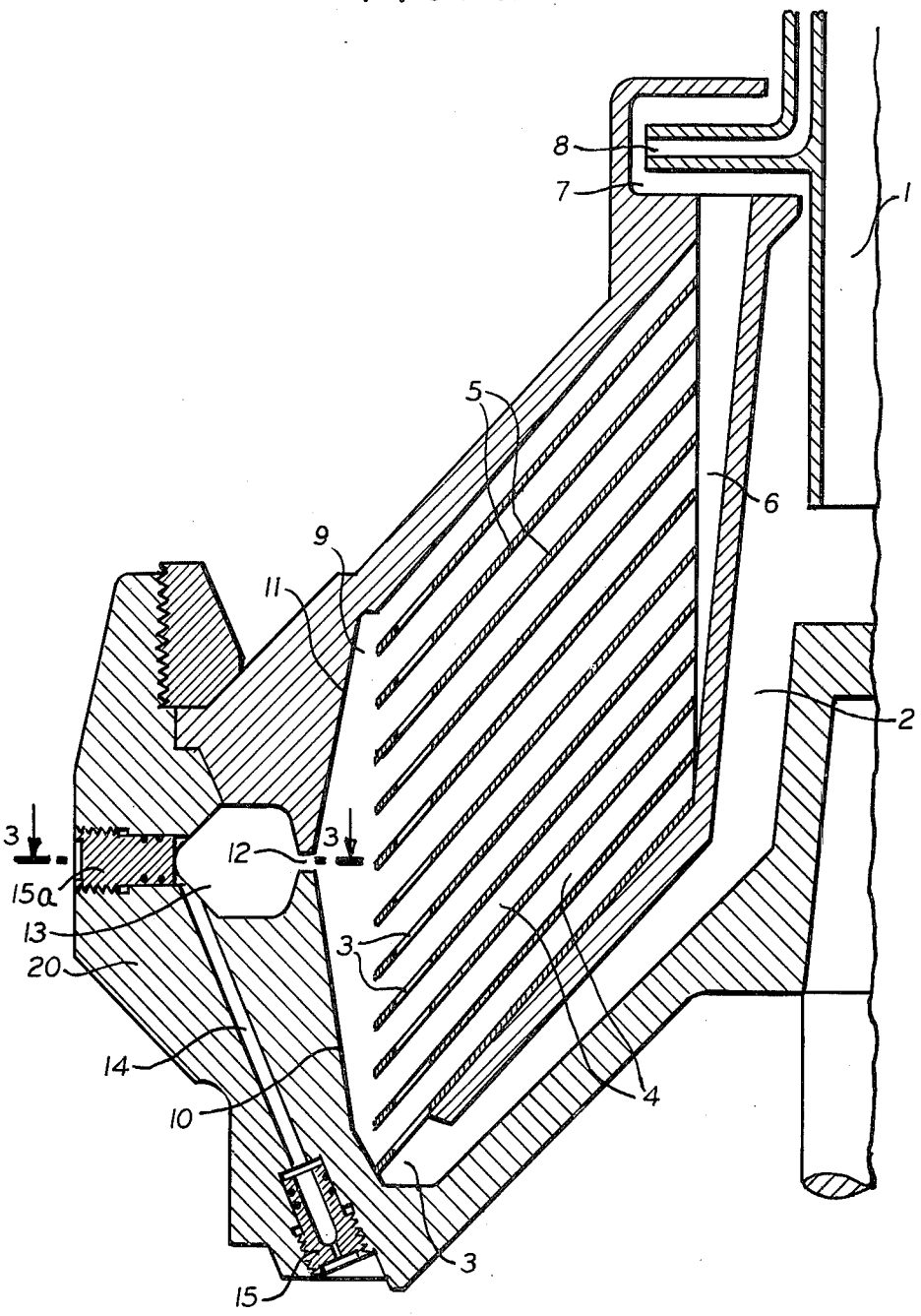
FIG. 1 is a cross sectional view of one half of a drum in which the concentrate is removed through nozzles.

In the centrifuge drum of FIG. 1, the liquid to be sterilized passes at 1 through the inlet tube into the distribution chamber 2 and passes through the ascending passages 3 into the interstices 4 in the disk stack 5. The liquid purified in the interstices flows towards the drum axis through passages 6 into the paring chamber 7 and is removed by the paring disk 8. The specifically heavier, bacteria-laden solids in the disk stack slide outwardly under the action of the centrifugal force into the separating chamber 9 and along the smooth, conical surfaces 10 and 11 of the drum bottom 20 and of the drum cover respectively, through the narrow gap 12 into the concentrate chamber 13 that is provided in accordance with the invention. The removal of the concentrate is performed through passageways such as passageway 14, which include discharge nozzles such as nozzle 15.

Figure 2:
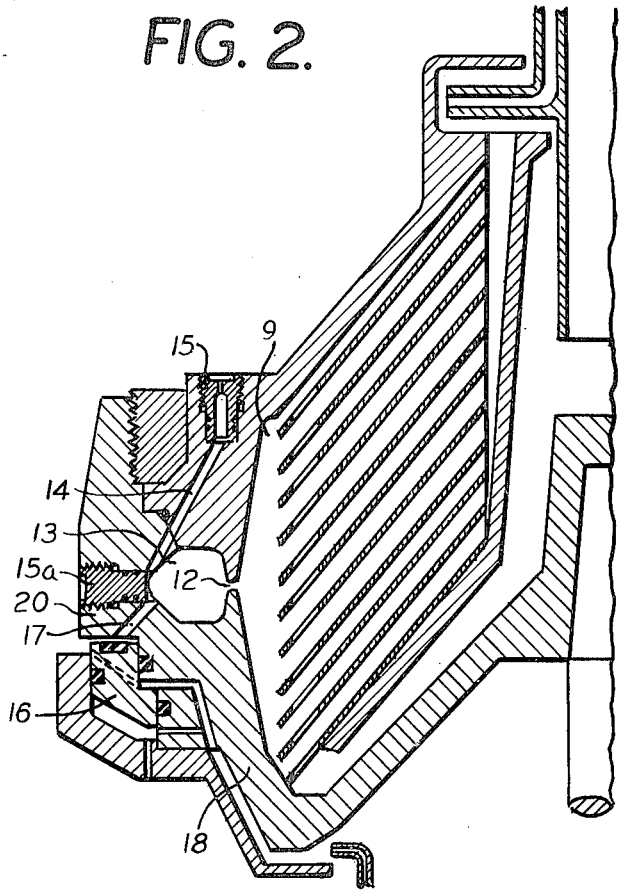
FIG. 2 is a cross sectional view of one-half of a drum in which the concentrate is removed through nozzles and/or by a self-discharging hydraulic system.

In the centrifuge drum in FIG. 2, the removal of the concentrate is also performed through passageways 14 having nozzle 15, but a removal of the collected concentrate or of the cones or pyramids of sludge formed in the concentrate chamber can be accomplished at periodic intervals through the passageways 17 which are located on the periphery of the concentrate chamber 13. Piston 16 is provided for opening and closing of passageways 17. In the last mentioned embodiment, the outlets of the passageways 17 can be at or outwardly of the periphery of the concentrate chamber 13.

Figure 3:
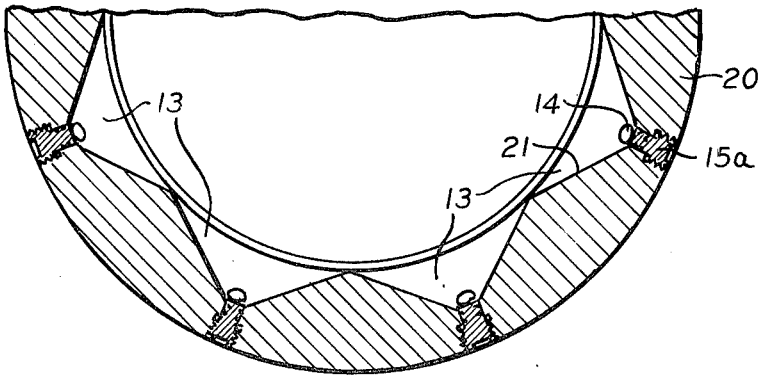
FIG. 3 is a cross sectional view on line 3—3 in FIG. 1.

In the centrifuge drum of FIG. 3, the concentrate chamber 13 is of a segment-shaped construction, so that the accumulation of solids is prevented. Thus, the concentrate chamber between the passageways 14, is contoured for flow of concentrate to those passageways. Contouring is provided by conically shaped recesses 21 having their apexes adjacent the inlet ends of passageways 14.

In the embodiments illustrated in the drawings, plugs 15*a* are provided. In an alternative embodiment plugs 15*a* can be replaced by nozzles for continuous discharge of concentrate from the periphery of the concentrate chamber.

The concentrate chamber 13, in size and configuration relative to the separating chamber, can be about as is indicated in the drawing. The gap 12 can be 0.5 – 2 mm in height.

THE SUMMARY

Thus, the invention provides an improvement in a centrifuge which is suitable for purification of a liquid comprising a specifically heavier concentrate fraction and a specifically lighter liquid fraction, comprising a drum for centrifuging which is rotatably mounted, an inlet to the drum for introduction of the liquid to be centrifuged, an outlet for removal of specifically lighter liquid fraction and a separating chamber adjacent the periphery of the drum for formation and collection of specifically heavier concentrate fraction. The improvement involves providing a concentrate chamber in the drum disposed radially outwardly of the separating chamber and about the drum axis, and which is smaller than the separating chamber. A plurality of passageways communicate the concentrate chamber with the exterior of the drum, for discharge of concentrate from the drum. A narrow annular gap communicates the separating chamber with the concentrate chamber, which gap is shorter in height than the height of the concentrate chamber. Thereby, accumulation of concentrate in the separating chamber is limited. The gap has an inlet defined by the inner surface of the drum outer wall, and the gap inlet is positioned at the locus of greatest separating chamber diameter. The concentrate chamber can be annular. Desirably, it is contoured for flow of concentrate from between the passageways to the inlets of the passageways.

What is claimed is:

1. In a centrifuge suitable for purification of a liquid comprising a specifically heavier concentrate fraction and a specifically lighter liquid fraction, comprising a drum for the centrifuging which is rotably mounted, an inlet to the drum for introduction of the liquid to be centrifuged, an outlet for removal of specifically lighter liquid fraction and a separating chamber adjacent the periphery of the drum defined in part by the inner surface of the drum outer wall for formation and collection of the specifically heavier concentrate fraction, the improvement which comprises:

a concentrate chamber in the drum disposed radially outwardly of the separating chamber and about the drum axis, and which is smaller than the separating chamber, a plurality of passageways communicating the concentrate chamber with the exterior of the drum for discharge of concentrate from the drum, means defining a narrow annular gap communicating the separating chamber with the concentrate chamber, the annular gap being shorter in height than the height of the concentrate chamber, so that accumulation of concentrate in the separating chamber is limited, said gap having an inlet defined by inner surface of the drum outer wall, the gap inlet being positioned at the locus of greatest separating chamber diameter, said inner surface of the drum outer wall being inclined for flow of concentrate from the separating chamber to said gap.

2. Centrifuge of claim 1, the concentrate chamber being annular.

3. Centrifuge of claim 1, wherein said passageways are disposed at spaced intervals about the drum, the concentrate chamber between the passageways being contoured for flow of concentrate to the discharge passageways.

4. Centrifuge of claim 1, said passageways having outlets disposed radially inwardly of the periphery of the concentrate chamber.

5. Centrifuge of claim 1, said passageways having outlets disposed at or outwardly of the periphery of the concentrate chamber.

6. Centrifuge of claim 1, comprising a hydraulic piston for opening and closing said passageways.

7. Process of purifying a liquid containing bacteria by removing the bacteria as a sludge from the liquid by centrifuging, which comprises centrifuging the liquid containing bacteria in a centrifuge of claim 1, and collecting the sludge in the concentrate chamber.

8. Process of claim 7, wherein the separating chamber is kept free of sludge during the centrifuging.

9. Centrifuge of claim 1, wherein the concentrate chamber communicates with the separating chamber only by way of said narrow gap.

* * * * *